US006898806B2

(12) United States Patent
Keramidas

(10) Patent No.: US 6,898,806 B2
(45) Date of Patent: May 31, 2005

(54) DEVICE FOR DISPENSING A LIQUID ACTIVE SUBSTANCE

(75) Inventor: Ioannis D. Keramidas, Attica (GR)

(73) Assignee: Skot S.A. Chemical Products, Attica (GR)

( * ) Notice: Subject to any disclaimer, the term of this patent is extended or adjusted under 35 U.S.C. 154(b) by 0 days.

(21) Appl. No.: 10/949,992

(22) Filed: Sep. 24, 2004

(65) Prior Publication Data

US 2005/0034226 A1 Feb. 17, 2005

Related U.S. Application Data

(63) Continuation-in-part of application No. 10/674,717, filed on Sep. 30, 2003.

(30) Foreign Application Priority Data

Oct. 1, 2002 (DE) ..... 202 15 129 U

(51) Int. Cl.[7] ..... E03D 9/02
(52) U.S. Cl. ..... 4/231; 4/223
(58) Field of Search ..... 4/222, 223, 231; 141/31

(56) References Cited

U.S. PATENT DOCUMENTS

| | | | |
|---|---|---|---|
| 3,946,488 A | 3/1976 | Miller et al. | |
| 6,178,564 B1 | 1/2001 | Leonard et al. | |
| 6,230,334 B1 | 5/2001 | Camp et al. | |
| 6,389,610 B1 | 5/2002 | Hautmann et al. | |
| 6,412,120 B1 | 7/2002 | Leonard et al. | |
| 6,591,431 B2 | 7/2003 | Hautmann et al. | |
| 6,651,261 B1 * | 11/2003 | Leonard et al. | 4/231 |

FOREIGN PATENT DOCUMENTS

| | | |
|---|---|---|
| EP | 0 538 957 | 10/1992 |
| EP | 0 785 315 | 11/1996 |
| EP | 0 878 586 | 4/1998 |
| GB | 2 345 494 | 7/2000 |
| WO | WO98/09027 | 3/1998 |
| WO | WO99/66140 | 12/1999 |
| WO | WO02/40787 | 5/2002 |

* cited by examiner

*Primary Examiner*—Tuan Nguyen
(74) *Attorney, Agent, or Firm*—Collard & Roe, P.C.

(57) ABSTRACT

A device for dispensing a liquid active substance into the flushing water of a toilet bowl has a supply container for containing the liquid active substance. The supply container has an opening in its underside and is retained in a carrying body which can be fixed on a rim of the toilet bowl. The carrying body has sidewalls and a base having an opening. Tabs disposed around a portion of the perimeter of the base opening project upwardly from the base. A distributor plate is secured to the carrying body and has a plug-in spike projecting upwardly through the base opening and into the supply container opening. The plug-in spike has grooves distributed circumferentially around it which are in fluid communication with the liquid active substance. Distributor channels in the distributor plate are in fluid communication with the grooves and with multiple capillary channels via branching locations in the distributor plate.

8 Claims, 5 Drawing Sheets

DEVICE FOR DISPENSING A LIQUID ACTIVE SUBSTANCE

CROSS REFERENCE TO RELATED APPLICATIONS

This application is a continuation-in-part of U.S. patent application Ser. No. 10/674,717, filed on Sep. 30, 2003, which claims priority under 35 U.S.C. § 119 of German Patent Application No. 202 15 129.8, filed on Oct. 1, 2002.

BACKGROUND OF THE INVENTION

1. Field of the Invention

The invention relates to a device for dispensing a liquid active substance into the flushing water of a toilet bowl.

2. The Prior Art

British Patent No. GB-A-2 345 494 discloses a device for dispensing a liquid active substance into a toilet bowl and has a distributor plate with capillary channels running through it. These capillary channels are connected to a spike-like extension which penetrates into an opening of a supply container for the liquid active substance. This achieves the situation where the capillary channels receive the liquid active substance until they have been filled. If the liquid active substance is flushed out of the distributor plate as a result of the toilet flushing, or if it partially evaporates, a corresponding quantity of liquid active substance runs in after it from the supply container. This prevents the liquid active substance from being dispensed in an uncontrolled manner from the supply container. If the device is intended to act as an air freshener, then the quantities of active substance accommodated in the capillary channels are usually not sufficient.

SUMMARY OF THE INVENTION

It is therefore an object of the invention to provide a device for dispensing liquid active substances which is better suited for dispensing liquid fragrances.

This object is achieved according to the invention by a device for dispensing a liquid active substance into the flushing water of a toilet bowl, comprising a supply container having an opening on the underside and being filled with the liquid active substance. This supply container preferably consists of transparent plastic, in order to easily check the filling level. In order for the supply container to be fitted easily without the liquid active substance being able to escape through the opening during the fitting operation, the opening is usually closed by a plug, which can be pushed away during insertion. The supply container is plugged into a carrying body which has fastening means for securing the device on the rim of the toilet bowl. A sealing means is preferably provided in the carrying body and/or on the supply container and, in the installed state of the supply container, prevents the liquid active substance from escaping in an uncontrolled manner. It is conceivable, in particular, to design a closure cap for the supply container from soft plastic, thus simultaneously forming the sealing means.

There is a distributor plate retained on the underside of the carrying body, by means of which the liquid active substance dispensed from the supply container is distributed over a corresponding surface area. For this purpose, the distributor plate has capillary channels which are connected to the opening of the supply container via distributor channels. These capillary channels ensure that a predetermined quantity of the liquid active substance is located on the surface of the distributor plate. This quantity depends, in particular, on the shape and size of the capillary channels and on the viscosity of the liquid active substance. The capillary channels here are located in a region of the toilet bowl which can be reached by the flushing water.

As a result of the flushing being actuated, the flushing water runs via the distributor plate and extracts the liquid active substance from the capillary channels. The capillary channels then remove a specifically defined quantity of liquid active substance again from the supply container. If the liquid active substance contains, inter alia, fragrances, then these are to be dispensed effectively to the ambient air.

It is important for the liquid active substance to be distributed over the largest possible surface area via the distributor plate since otherwise the achievable level of evaporation would be too low. It is therefore necessary to have a multiplicity of capillary channels which are arranged closely beside each other. Supplying this multiplicity of capillary channels with the liquid active substance directly from the opening of the supply container would result in a very large surface area and complicated construction of the distributor plate, which makes it more difficult to fit the device in the toilet bowl. In order to solve this problem, the distributor channels are branched and connected to a plurality of capillary channels in each case. Each distributor channel thus supplies a plurality of capillary channels, with the result that, despite the large number of capillary channels present, only a comparatively small number of distributor channels is necessary. These distributor channels may be accommodated in a relatively straightforward and space-saving manner on the distributor plate in the region beneath the supply container, with the result that the device is nevertheless of compact and straightforward construction.

So that the closure cap of the supply container can be easily removed as the supply container is inserted into the carrying body, the distributor plate preferably has an upright plug-in spike. This plug-in spike preferably has vertically running grooves which form channels for the liquid active substance. In order to ensure that the liquid active substance is distributed uniformly over all the distributor channels, this plug-in spike may be enclosed by an annular groove, from which the distributor channels extend. This ensures a uniform distribution of the liquid active substance over all the capillary channels of the distributor plate.

In order to keep the number of necessary distributor channels sufficiently low, it is preferable if the distributor channels are branched a number of times one behind the other over their length. It is conceivable, in particular, for the distributor channel to be split up, at each branching location, into two, and possibly also three, channels, with the result that, in the case of two branching locations arranged one behind the other, each distributor channel can supply four or nine capillary channels.

In order to ensure that the liquid active substance is distributed quickly and uniformly over the branched distributor channels, it is advantageous if the distributor channels in the distributor plate branch at an acute angle, and a wedge is formed in the region of each branching location. The liquid active substance continues flowing, by way of the acute-angled branching location, in more or less the same direction and is not subjected to any resistance, as in the case of a right-angled branching location. The wedge-formed branching location has proven very advantageous here because the flow direction is barely changed if the wedge is oriented preferably parallel to the longitudinal extent of the capillary channels.

In order for the distributor channels to be accommodated in a space-saving manner in the distributor plate, the cross section thereof should not be of excessively large dimensions. On the other hand, the distributor channels have to transport correspondingly more liquid active substance before each branching location than following the corresponding branching location, where the liquid stream is distributed over correspondingly more lines. It is thus preferable if the distributor channels have a smaller cross section following each branching location than before the branching location. This ensures that the capillary channels are supplied with sufficient liquid active substance from the distributor channels. In order to avoid build-ups of the liquid active substance at the branching locations, the sum of the cross sections of the branched distributor channels is at least equal to the cross section of the non-branched distributor channel. If the distributor channel divides up, for example, into two sub-channels at a branching location, then the cross section of the sub-channels is at least half that of the non-branched distributor channels. The liquid active substance transported by way of the distributor channel can thus pass the branching location without obstruction.

The cross sections of the branched distributor channels are preferably dimensioned such that their sum is somewhat greater than the cross section of the non-branched distributor channel. This takes into account the capillary forces increasing as the channel cross section decreases. The distributor channels extending from the annular channel preferably have a cross section of between 0.2 $mm^2$ and 1 $mm^2$. In the case of the distributor channel branching into two sub-channels, the sub-channels have a cross section of between 50% and 80%, preferably around 60%, of the non-branched distributor channel. These sub-channels preferably open out into a second branching location, which is adjoined directly by the capillary channels. These capillary channels have a cross section which is preferably from 25 to 50% (in particular around 30%) of the non-branched distributor channel.

In order for the distributor plate to be produced by injection molding and be demolded as straightforwardly as possible, the distributor and/or capillary channels preferably have a V-shaped cross-section. This V-shape, moreover, has the additional advantage that these channels subject the liquid active substance to particularly effective capillary forces. The opening angle of these channels is preferably between 40° and 120°, an opening angle of 80° being sought after in particular. With a larger opening angle, the dispensing surface area of the liquid active substance is likewise larger.

In order to achieve a compact construction of the distributor plate, it is important for the distributor channels to be located essentially beneath the supply container. Moreover, the distributor channels have to have connections both to the annular groove and to the capillary channels, and the annular groove should be of the smallest possible dimensions. To fulfil these requirements, the distributor channels should be spaced apart from one another by approximately equal distances as they branch off from the annular groove. The circumference of the annular groove is optimally utilized here in order to connect the distributor channels. The distributor channels run in an arcuate manner in order to make it possible, with a space-saving construction of the distributor plate, for the liquid active substance to flow in a favorable, unobstructed manner. In the region of the annular groove, the distributor channels enclose with the annular groove an angle which is more acute as the distance between the capillary channels and the point at which the annular groove merges into the distributor channel increases. In this case, the distributor channels for supplying the capillary channels located directly opposite the annular groove run essentially radially in relation to the annular groove, while the distributor channels for supplying the capillary channels on the edges extend more or less tangentially from the annular groove. The distributor channels open out in an approximately aligned manner into the capillary channels, in order to keep flow resistances low.

In another embodiment, a plurality of grooves are circumferentially distributed around an upright plug-in spike. The grooves are in fluid communication with a liquid active substance from the supply container. A plurality of distributor channels extend from a base of the upright plug-in spike and are in fluid communication with the grooves of the upright plug-in spike so that a liquid active substance may flow directly from the groove to the distributor channels.

In order to ensure a uniform distribution of the liquid active substance over the distributor plate, it is important for the distributor plate to be oriented precisely horizontally. The device is firmly clipped on the rim of the toilet bowl by a resilient clip which is provided on the carrying body. In order to prevent the device with its distributor plate from moving from the horizontal position into a slanting position, abutments are integrally formed on the carrying body and engage beneath the rim of the toilet bowl. These abutments are located on both sides of the resilient clip, resulting in a three-point suspension means between the two abutments and the resilient clip, which is particularly stable.

The resilient clip is retained in a height-adjustable manner on the carrying body to ensure that the device is secured sufficiently firmly on the rim of the toilet bowl. It is thus possible for the resilient clip to be adapted to the respective rim of the toilet bowl. The height-adjustment device of the resilient clip is provided with latching means to prevent the resilient clip from shifting gradually in relation to the carrying body.

The abutments are preferably provided on mutually opposite end regions of the wall of the carrying body, to give the three-point mounting the widest possible configuration so that the device is fixed in a particularly stable manner on the rim of the toilet bowl.

To prevent the liquid active substance from escaping from the distributor plate on the side located opposite the capillary channels, a wall is preferably integrally formed on the distributor plate. This wall partially engages over the carrying body laterally and, on three sides, forms a tray for the liquid active substance. This wall extends along the side which is located opposite the capillary channels and, in the toilet bowl, is directed towards the center. Moreover, this wall partially extends over the adjoining end sides, in order to form a termination at these locations. The wall could also be routed parallel to the capillary channels. A sealing groove is formed in the distributor plate on the inside of the wall and has a correspondingly shaped sealing lip of the carrying body engaging in it. This sealing lip, together with the sealing groove and the boundary wall, forms a labyrinth for the liquid active substance, with the result that the liquid cannot escape on the side of the device located opposite the capillary channels.

So that the liquid active substance no longer drips down from the sides of the distributor plate after flushing, it is of great advantage have a hollow with a siphon in the bottom of the plate, whose over-flow edge is below the capillary channels. The excess liquid in the capillary channels only runs into the hollow after flushing. The siphon with its over-flow edge is positioned so far under the capillary channels and also below the end edge of the distributor plate, that the liquid running into the hollow only runs out via the siphon into the toilet bowl.

It is advantageous to form the hollow in the distributor plate as a groove which serves as the end running crossways at the open end of the capillary channels. The groove is only formed as a frontal end in front of the capillary channels. The groove shows a deep point where the low-position siphon is located. The groove is deep enough so that the siphon with its over-flow edge remains under the capillary channels, so that the liquid traces only run out through the siphon and do not drip down over the sides. Alternatively, the groove could span the capillary channels on three sides, which would increase reliability.

Furthermore, it is advantageous if the hollow in the distributor plate is formed as a shaft, which extends over several capillary channels and which is connected to a cross groove at the open end of the capillary channels. The hollow, formed as a shaft, is incorporated in the distributor plate and the result thereby is a smaller unit. As there are only little traces of liquid after flushing, a small shaft integrated in the capillary channels, in which the siphon is positioned, is sufficient.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENTS

Figure 1:
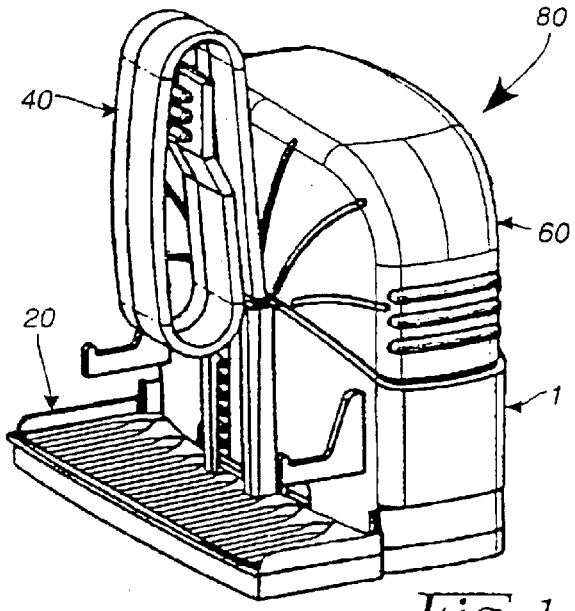
FIG. 1 shows a shows a three-dimensional illustration of a device for dispensing a liquid active substance according to the invention.

Referring now in detail to the drawings, FIG. 1 shows a device 80 for dispensing a liquid active substance. Device 80 comprises a carrying body 1, on the underside of which a distributor plate 20 is secured. A resilient clip 40 is provided on carrying body 1 and keeps device 80 on the rim of a toilet bowl (not illustrated). A supply container 60, which contains the liquid active substance, is plugged into carrying body 1. Device 80 is explained in more detail hereinbelow with reference to the illustrations shown in FIGS. 2 to 5.

Figure 2:
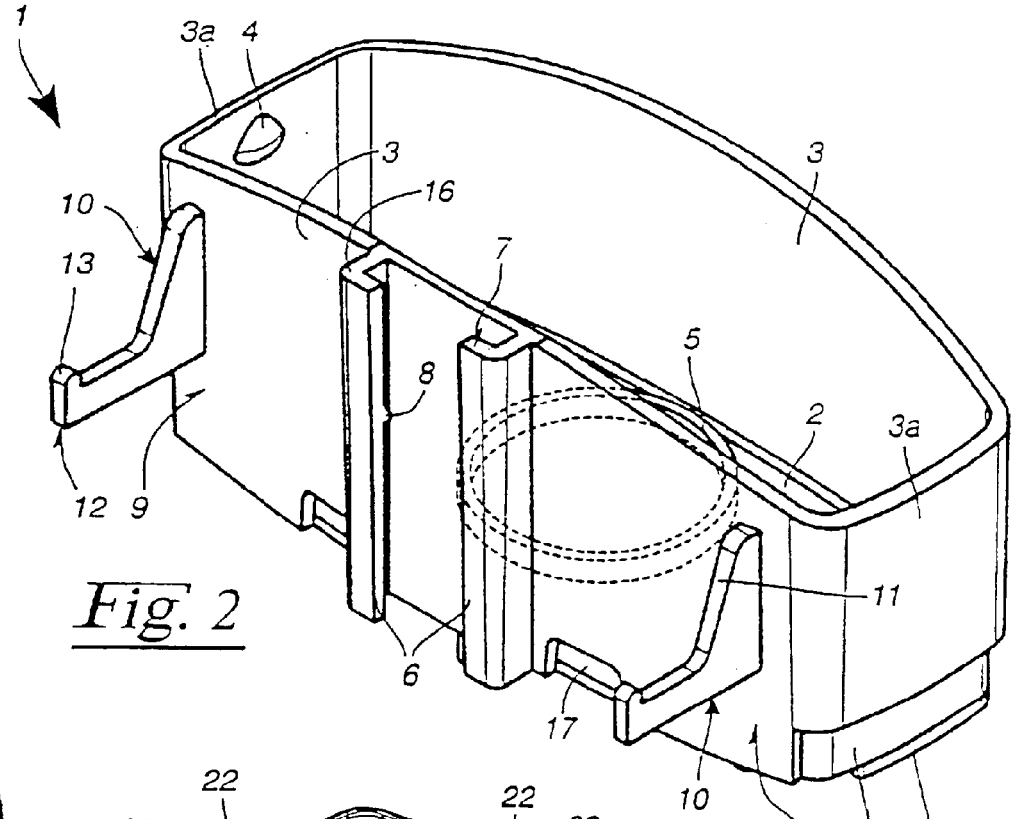
FIG. 2 shows a three-dimensional illustration of a carrying body.

FIG. 2 shows carrying body 1 of device 80. This carrying body 1 has a base 2, from which four side walls 3, 3*a* extend upwards. Latching noses 4 are integrally formed on the inside of two mutually opposite end sides 3*a* of carrying body 1, and accommodate supply container 60 with arresting action. Integrally formed in base 2 is an inwardly oriented tubular mount 5 (illustrated by dashed lines), within which base 2 is interrupted.

In an upright position approximately in the center of one side wall 3 are two outer rails 6, which are spaced apart from one another by a small distance and accommodate resilient clip 40. Rails 6, which are positioned on side wall 3, are angled in relation to one another at their free end 16, with the result that they may serve as a guide and retaining means for a plug-in rail or clip. In angled region 7, latching means 8 in the form of projecting teeth are integrally formed on the inside of rails 6. These latching means 8, in conjunction with a row of latching channels 42 on resilient clip 40, secure the clip 40, which can be height-adjusted in rails 6 and which will be discussed at a later stage of the text.

In the two end regions 9 of side wall 3, on both sides of rails 6, abutments 10, which project in relation to clip 40, are integrally formed on the carrying body 1. These abutments are directed away essentially at right angles from side wall 3. In order to achieve a good grip of abutments 10 on side wall 3, abutments 10 have slopes 11, with the result that abutments 10 are connected to side wall 3 over correspondingly enlarged surface areas. At free end 12, upwardly directed hooks 13 are integrally formed on abutments 10, so that the hooks engage behind a rim (not illustrated) of a toilet bowl. These abutments 10 provide the device with a good aligned grip on the toilet bowl. Furthermore, side wall 3 has small openings 17 on the base, alongside rails 6, so that undesirable liquid collected in the carrying body 1 can flow out from these openings.

Three side walls 3, 3*a* have, on the underside, a step-like tapered portion 14 for adapting distributor plate 20 to carrying body 1. It would be possible, in principle, for this step-like tapered portion 14 to run all the way around the entire carrying body 1. It is sufficient, however, for this step-like tapered portion 14 to be provided—as is illustrated—only on those walls 3, 3*a* which do not bear the abutments 10. In the region of the step-like tapered portion 14, a sealing lip 15 is integrally formed on the underside of side walls 3, 3*a*, and forms a liquid-tight connection between carrying body 1 and distributor plate 20 when these are plugged together.

Figure 3:
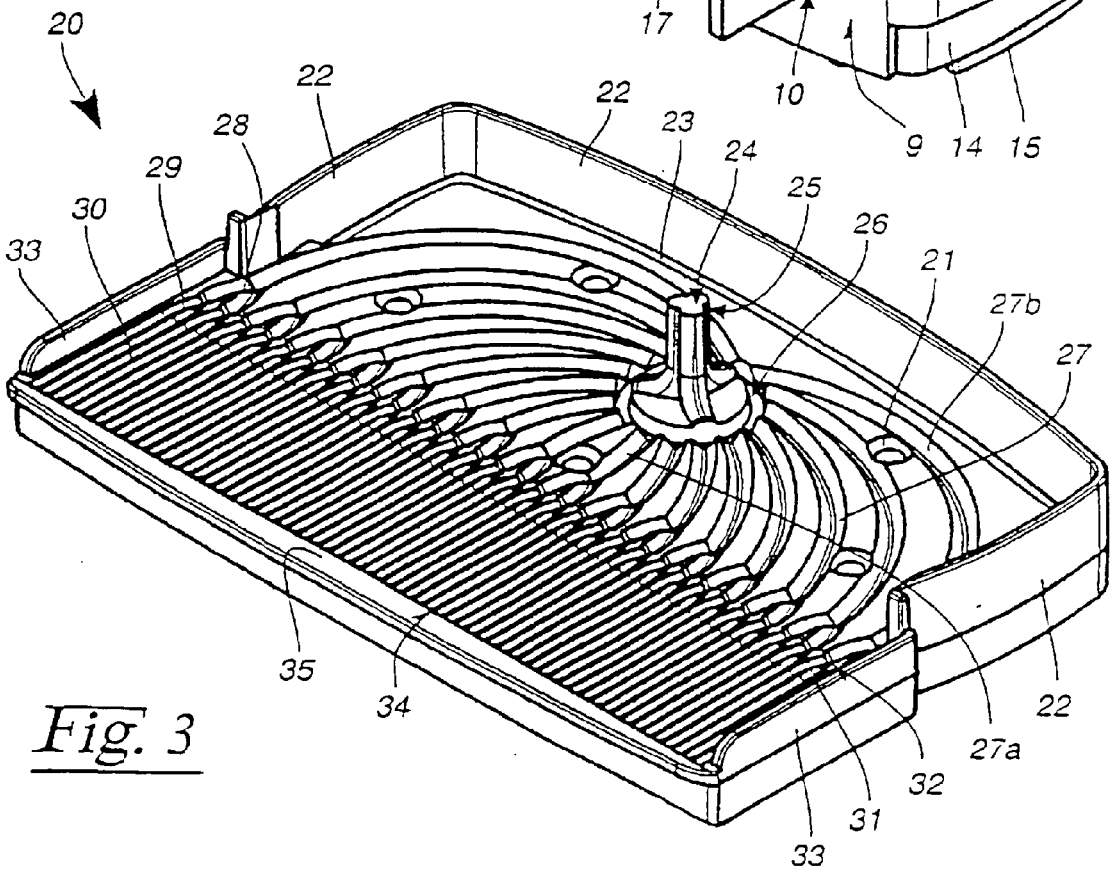
FIG. 3 shows a three-dimensional illustration of a distributor plate.

FIG. 3 shows distributor plate 20, which is plugged onto the underside of carrying body 1. For the purpose of connecting distributor plate 20 to carrying body 1, a plurality of through-passages 21, which are undercut to a slight extent, are provided in distributor plate 20. Integrally formed on base 2 of carrying body 1 are correspondingly designed pins (not illustrated) which are aligned appropriately with through-passages 21. As a result of the pins of carrying body 1 being plugged into through-passages 21 of distributor plate 20, the two parts 1, 20 are connected to one another in a firm and also sealing manner there.

Distributor plate 20 has, on three abutting sides, an upwardly extending wall 22, which interacts with the step-like tapered portion 14 of carrying body 1. Wall 22 here is designed such that it is aligned with side walls 3, 3*a*. Wall 22 prevents the liquid active substance from escaping from distributor plate 20 at an undesirable location. A sealing groove 23 is formed in distributor plate 20 on the inside of wall 22 and has sealing lip 15 of carrying body 1 engaging in it. This produces a double labyrinth for the liquid active substance located on the distributor plate 20, with the result that the substance cannot escape via the location of connection to carrying body 1.

An upright plug-in spike 24 is integrally formed on distributor plate 20, approximately centrally within wall 22. This plug-in spike 24 engages through the center of tubular mount 5 of carrying body 1. When supply container 60 is inserted into carrying body 1, plug-in spike 24 pushes a closure cap of supply container 60 into the latter in order to open it. Plug-in spike 24 here is designed such that the closure cap of supply container 60 is only pushed into the latter when the container is already positioned with sealing action in mount 5. This avoids the situation where the active substance contained in supply container 60 flows out in an uncontrolled manner.

Plug-in spike 24 has three circumferentially distributed longitudinal grooves 25 which, together with a sealing cap enclosing an opening of supply container 60, form discharge channels for the liquid active substance. These discharge channels open out into an annular groove 26, which is arranged concentrically around plug-in spike 24. The liquid active substance passing out of supply container 60 collects in annular groove 26.

Cross-sectionally V-shaped distributor channels 27 extend away from annular groove 26 in a circumferentially more or less uniformly distributed manner. These distributor channels 27 have a depth of approximately 1 mm with an opening angle of approximately 80°, distributor channels 27 being of cross-sectionally symmetrical design. Distributor channels 27 run in an arcuate manner and open out into capillary channels 30 via two branching locations 28, 29 which are arranged one behind the other. Due to branching locations 28, 29, each distributor channel 27 supplies four capillary channels 30. A wedge 31 is integrally formed in distributor plate 20 in the region of each branching location 28, 29, and this wedge ensures that the liquid active substance is divided up uniformly over individual capillary channels 30. The branched distributor channels 27 have a depth of approximately 0.8 mm with an opening angle of approximately 80°. The capillary channels 30 have a depth of approximately 0.6 mm with an opening angle of 80°.

Distributor channels 27 open out into branching locations 28, 29 approximately in alignment with the capillary channels 30, with the result that the ends 32 thereof are located parallel to one another. In the region of annular groove 26, distributor channels 27 are spaced apart from one another by approximately equal distances. Those distributor channels 27*a* which are located closest to capillary channels 30 extend approximately radially from annular groove 26 and open out into central capillary channels 30. Those distributor channels 27*b* which supply the respectively outermost capillary channels 30 extend more or less tangentially away from annular groove 26. The distributor channels 27, which are located between distributor channels 27*a* and 27*b*, are positioned, in relation to annular groove 26, at an angle which decreases gradually from distributor channel 27*a* to distributor channel 27*b*. This results in a fountain-like structure of distributor channels 27, which extend from annular channel 26 and open out into capillary channels 30.

On both sides, distributor plate 20 has, as a boundary for capillary channels 30, low-height walls 33 which prevent the liquid active substance from flowing out laterally in an uncontrolled manner. A termination edge 35, which runs in an arcuate manner, is provided on distributor plate 20 in the region of ends 34 of capillary channels 30. This termination edge 35 is adapted essentially to the shape of the toilet bowl and is angled slightly upwards towards the free end in order to prevent dripping.

Distributor plate 20 is arranged in the toilet bowl such that capillary channels 30 end up located beneath the flushing means. Capillary channels 30 are thus washed out with flushing water during each flushing operation, whereupon the liquid active substance, which is somewhat viscous, is drawn into the capillary channels 30 again. In this way, depending on the frequency of flushing actuation, a correspondingly metered quantity of the liquid active substance is removed from supply container 60 and fed to the capillary channels 30. Should any liquid active substance drip out of openings 17 of side wall 3, then it drops onto capillary channels 30 and is properly distributed.

Figure 4:
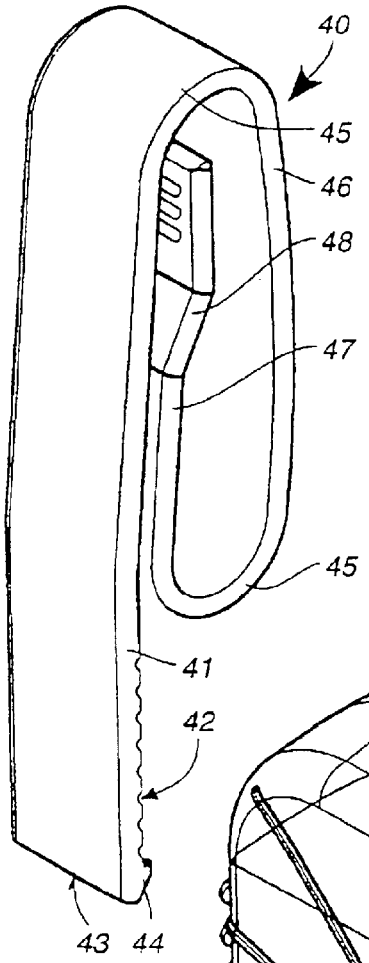
FIG. 4 shows a three-dimensional illustration of a resilient clip.

FIG. 4 shows resilient clip 40, which secures carrying body 1 on the rim of the toilet bowl. Resilient clip 40 has an essentially vertically oriented web 41, which can be introduced between the two angled rails 6 of carrying body 1. Web 41 has transversely running latching channels 42, which interact with latching means 8 of carrying body 1. These latching channels 42 allow resilient clip 40 to be secured in a height-adjustable manner relative to carrying body 1. It is thus possible for the length of resilient clip 40 to be adapted to the dimensions of the respective toilet bowl. In the region of free end 43, a nose 44 is integrally formed on web 41, said nose being intended to make it more difficult for resilient clip 40 to be drawn all the way out of rails 6. This prevents the carrying body 1 from dropping into the toilet bowl in the event of resilient clip 40 being subjected to excessive tensile forces.

Resilient clip 40 has two regions of deflection 45, each running through approximately 180°. By virtue of the two regions of deflection being bent open to approximately 90° in each case, a segment 46 between the two regions of deflection 45 is arranged such that it ends up located on the top side of the bowl rim. A free segment 47 here acts with clamping action on the outside of the toilet-bowl rim. This free segment 47 has an angled portion 48, which causes the resilient clip 40 to be firmly connected to the toilet-bowl rim.

Figure 5:
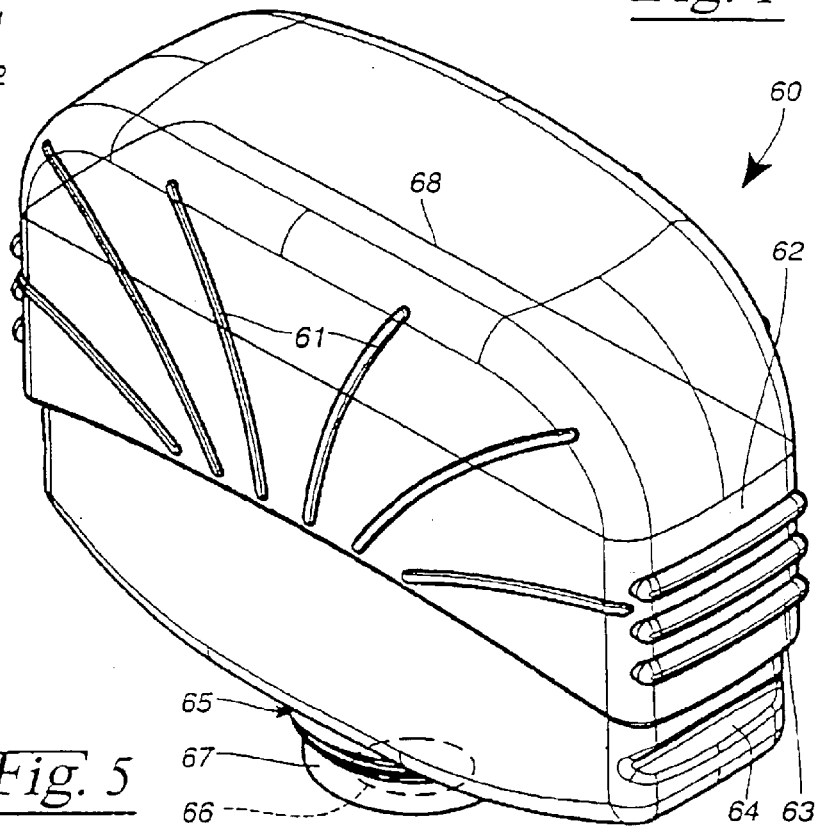
FIG. 5 shows a three-dimensional illustration of a supplying container for the liquid.

FIG. 5 shows supply container 60, which can be plugged into carrying body 1. Supply container 60 is of relatively narrow design, in order to project as little as possible into the toilet bowl. Supply container 60 has, in the wall, stiffening ribs 61 which run in an arcuate manner and diverge essentially in the form of rays. They may be formed by stamping or embossing. These stiffening ribs 61 ensure a rigid-walled design of supply container 60 and, at the same time, that supply container 60 has a decorative appearance. The stiff-walled design of supply container 60 is important, in particular, since the latter consists of a transparent plastic, for example PVC or PET G, which usually has a relatively low level of inherent rigidity. A transparent design of supply container 60 is important in order to check the filling level in supply container 60. On end sides 62, supply container 60 has ribs 63, which allow better gripping of supply container 60. This is advantageous if supply container 60 is to be exchanged and thus removed from carrying body 1. Latching depressions 64 are formed in the end sides 62, beneath stiffening ribs 63, and interact with latching noses 4 of carrying body 1. Latching depressions 64 ensure a satisfactory grip of supply container 60 in carrying body 1.

Supply container 60 has a neck region 65 in which an opening 66 is provided. A sealing cap 67, which is adapted to mount 5 of carrying body 1, is fitted over neck region 65. As soon as supply container 60 is plugged into carrying body 1, sealing cap 67 ensures a sealed connection between supply container 60 and mount 5 of carrying body 1.

A liquid active substance 68, in particular a fragrance and cleaning agent, is introduced into supply container 60. This liquid active substance 68 passes, via opening 66, to distributor plate 20. There, it is drawn, via longitudinal grooves 25 of plug-in spike 24, annular groove 26 and distributor channels 27, into capillary channels 30, from where the flushing water flushes out the liquid active substance.

Figure 6:
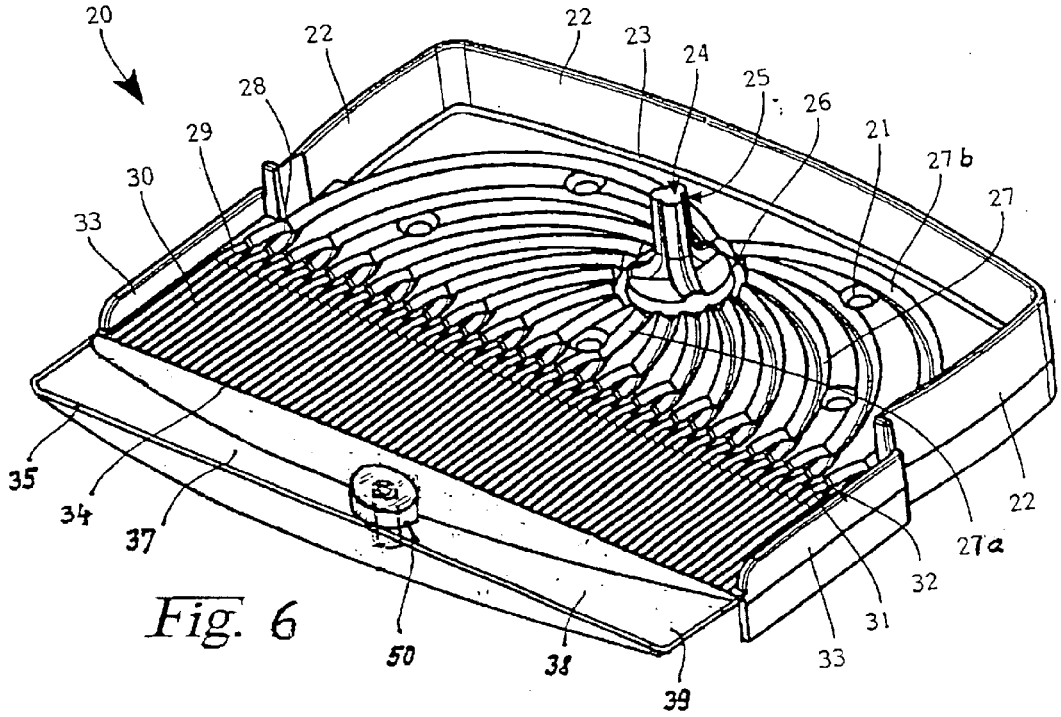
FIG. 6 shows a modified distributor plate according to the invention.

In FIG. 6, in contrast to FIG. 3, a modified distributor plate 20 can be seen, which shows a hollow 36 on open end 34 of capillary channels 30 in the bottom of plate 37, which is formed as a cross groove 38. This cross groove 38 has its deepest point in the center and flattens out towards side edge 39. On the deepest point, a siphon 50 is positioned, which goes through the bottom of plate 37. The siphon 50 will be described in more detail later. The liquid remaining in capillary channels 30 after flushing can only flow or drop into cross groove 38, because side-wall 33 of distributor plate 20 does not allow it to go any other way. When cross groove 38 fills with liquid, this flows away via the siphon if the liquid rises above over-flow edge 53.

Figure 7:
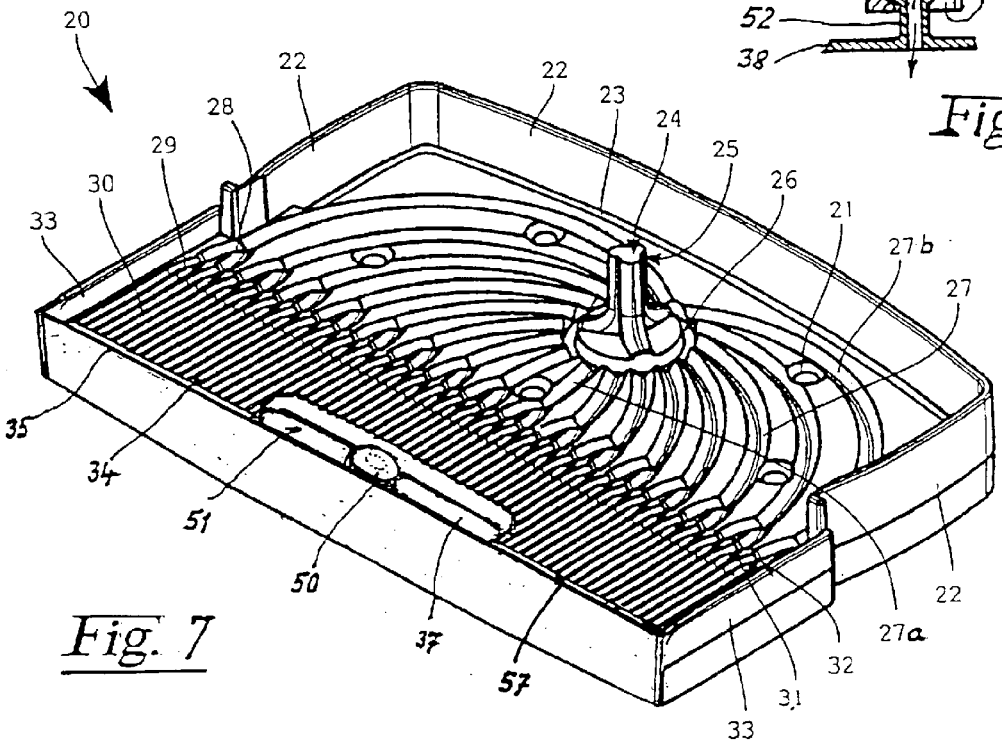
FIG. 7 shows another variation of the distributor plate according to FIG. 6.

In FIG. 7, distributor plate 20 is formed with another hollow 36. Hollow 36 is formed as a shaft 51, which extends crossways over a number of capillary channels 30. At the end 34 of capillary channels 30 there is a branch groove 57 running crossways, over which the remaining liquid from the outer capillary channels 30 flows into shaft 51. As a result, the remaining liquid in grooves 30 collects in shaft 51 after flushing and flows through siphon 50 into the toilet bowl only when a certain height is reached. Also, with siphon 50, over-flow edge 53 is positioned under capillary channels 30.

Figure 8:
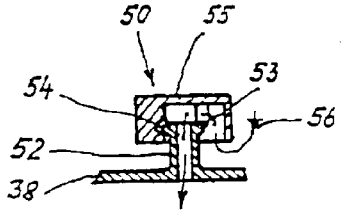
FIG. 8 shows an embodiment of a siphon according to the invention.

In FIG. 8, an embodiment of a siphon 50 is shown. Through the bottom of plate 38 the stand-pipe extends with its upper over-flow edge 53, which shows a bulge 54 on the edge. On this bulge 54 an attached cap 55 is fixed. With 56, the flow of the liquid through the siphon 50 can be seen. It is clear that the liquid can only flow through siphon 50, if the level of the liquid is higher than over-flow edge 53.

Figure 9:
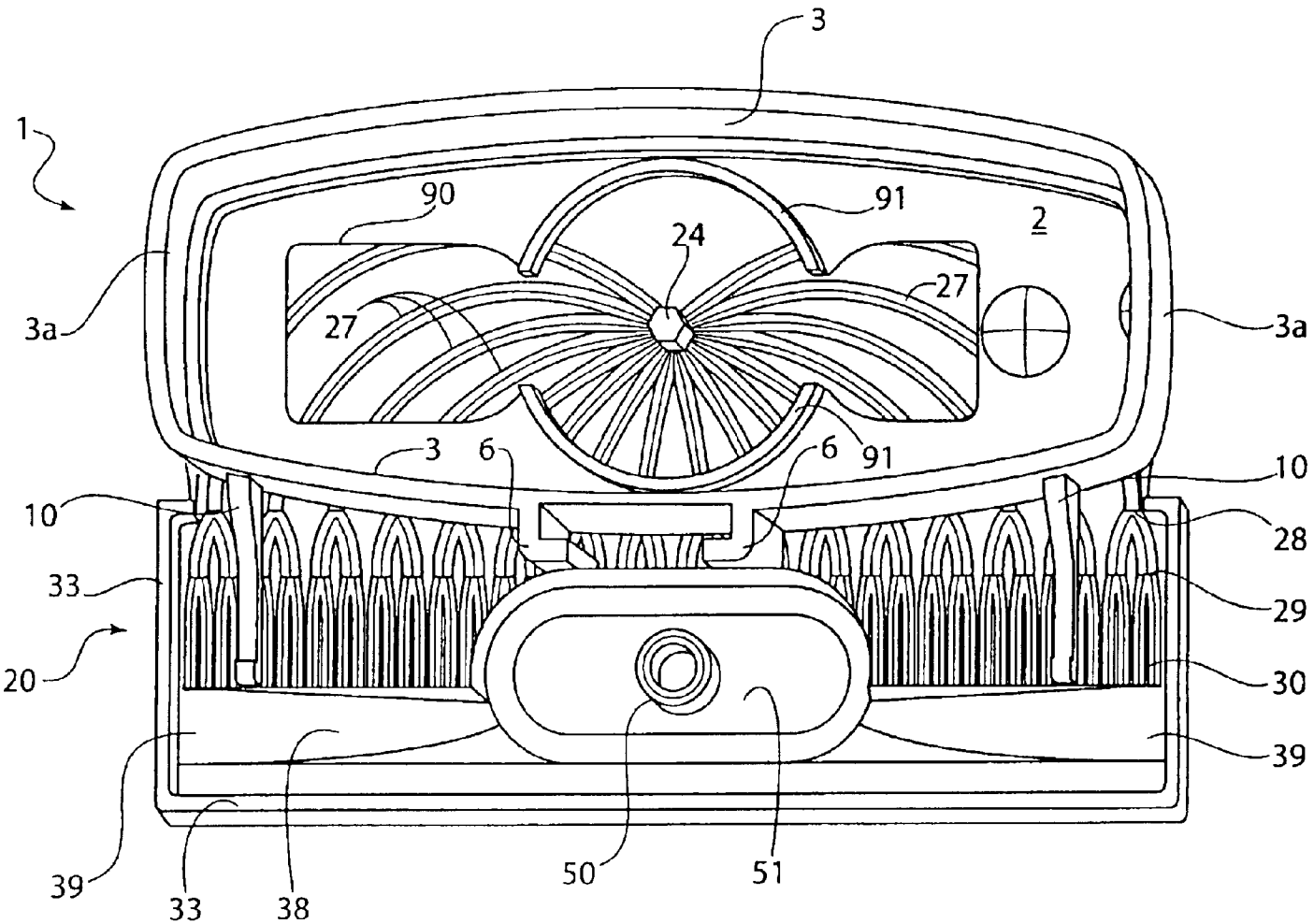
FIG. 9 shows a top view of a carrying body and a distributor plate according to another embodiment of a device for dispensing a liquid active substance according to the invention.
Figure 10:
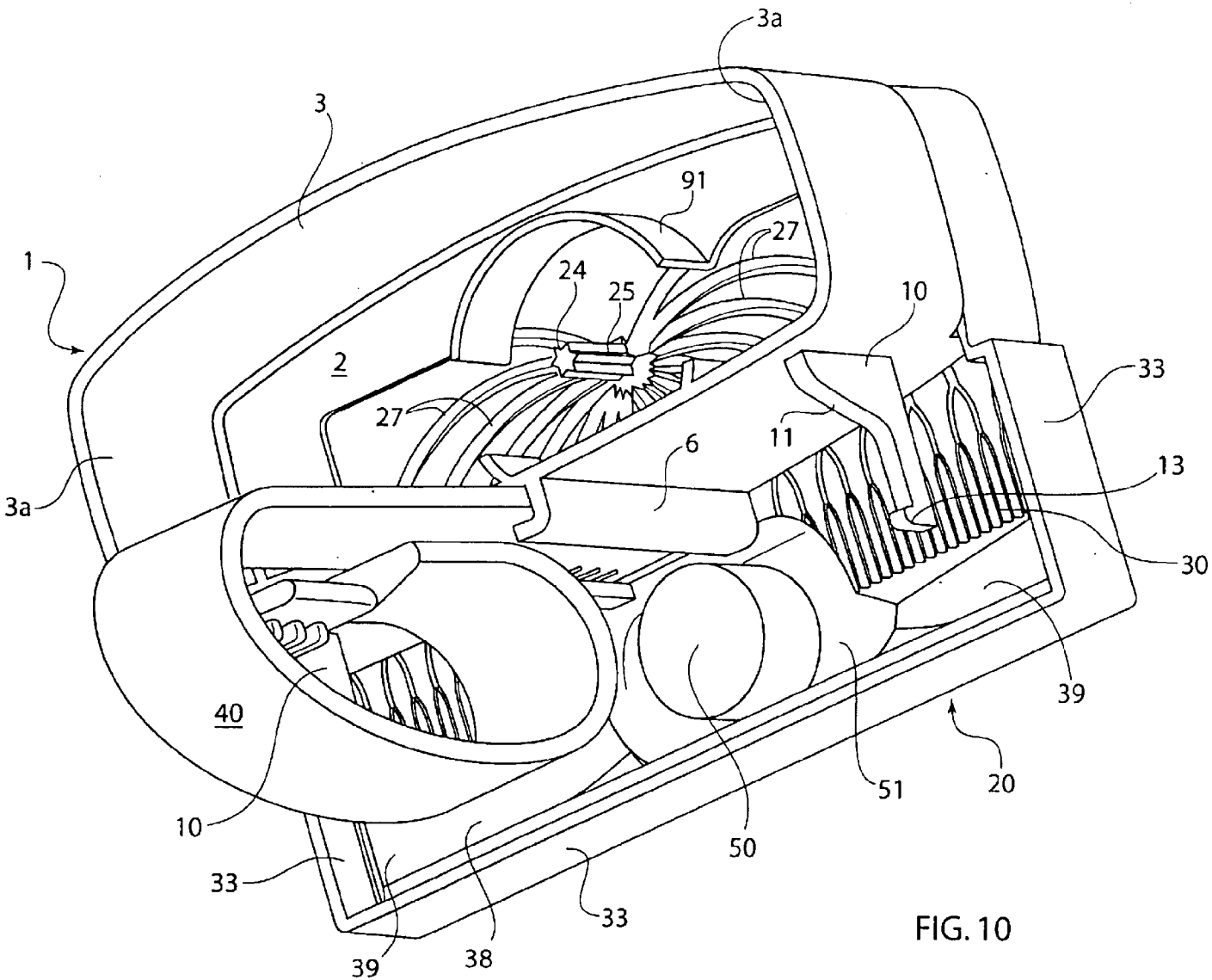
FIG. 10 shows a three dimensional illustration of a carrying body, a distributor plate and a resilient clip according to an embodiment of a device for dispensing a liquid active substance according to the invention.

In FIGS. 9 and 10, a top view and a three-dimensional view of a carrying body and a distributor plate according to another embodiment of a device for dispensing a liquid active substance according to the invention are shown. Carrying body 1 includes a base 2 from which four sidewalls 3, 3*a* extend upwards.

Two outer rails 6 are disposed in the approximate center of one sidewall 3 and spaced apart from one another. As shown in FIG. 10, outer rails 6 accommodate and support resilient clip 40.

Abutments 10 are integrally formed with carrying body 1 and project out from a sidewall 3. Abutments 10 are disposed on an end region of carrying body 1 on either side of outer rails 6. Abutments 10 have a sloped region 11 such that a relatively large surface area of abutment 10 is in contact with sidewall 3, and a upwardly directed hook 13 for engaging behind a toilet bowl rim (not shown).

An opening 90 is provided in base 2 of carrying body 1. As shown in FIG. 9, opening 90 may comprise a substantial portion of base 2 of carrying body 1 such that a relatively large region of base 2 is open to distributor plate 20. For example, opening 90 may include a rounded portion corresponding to neck region 65 of supply container 60, as well arm like portions projecting from either side of a rounded portion and extending toward either side of carrying body 1.

Semicircular tabs 91 project upward from base 2 of carrying body 1 around a portion of opening 90. A supply container which contains a liquid active substance can be plugged into carrying body 1 at semicircular tabs 91. Semicircular tabs 91 may comprise, for example, two curved tabs projecting upwardly from base 2. Tabs 91 may be located on a portion of a perimeter of opening 90, such that tabs 91 do not cover all of opening 90.

Distributor plate 20 is secured to an underside of carrying body 1. Distributor plate 20 includes an upright plug-in spike 24 which is disposed approximately centrally to semicircular tabs 91. Plug-in spike 24 opens a closure cap of a supply container when the supply container is plugged into carrying body 1.

Plug-in spike 24 may have circumferentially distributed grooves 25 which form discharge channels for a liquid active substance.

A plurality of distributor channels 27 having V-shaped cross-sections are disposed on distributor plate 20. Distributor channels 27 emanate from a base or bottom portion of plug-in spike 24 and extend in a bowed or arcuate manner away from plug-in spike 24. Distributor channels 27 may have, for example an opening angle of approximately 80° and a depth of approximately 1 mm. Distributor channels 27 are approximately uniformly distributed with respect to plug-in spike 24 and may be symmetrical in cross-section.

Each distributor channel 27 is in fluid communication with capillary channels 30 via branching locations 28 and 29. Each distributor channel 27 may supply four capillary channels 30. Branched distributor channels may have, for example an opening angle of approximately 80° and a depth of approximately 0.8 mm. Capillary channels 30 may have, for example an opening angle of approximately 80° and a depth of approximately 0.6 mm.

Distributor plate 20 may also include low height walls 33 which bound capillary channels 30 and prevent an active liquid substance from flowing out laterally in an uncontrolled manner.

Distributor plate 20 is arranged in a toilet bowls such that capillary channels 30 are beneath the flushing means. During each flushing operation capillary channels 30 are washed out with flushing water and a metered quantity of liquid active substance is delivered to the toilet bowl.

As shown in FIGS. 9 and 10, distributor plate 20 may have a hollow at the end of capillary channels 30, formed as a cross groove 38 which is deepest toward a center portion and flattens out toward side edges 39. Distributor plate 20 may also have additional hollow formed as a shaft 51 which extends across a number of capillary channels 30. A siphon 50 extending through cross groove 38 is located in the center of shaft-shaped hollow 51 such that when an active liquid substance in hollow 51 rises above a certain level, the liquid flows into the toilet bowl via siphon 50.

Accordingly, while only a few embodiments of the present invention have been shown and described, it is obvious that many changes and modifications may be made thereunto without departing from the spirit and scope of the invention.

List of Reference Numerals

1 Carrying body
2 Base
3 Side wall
3*a* End wall
4 Latching nose
5 Mount
6 Rail

7 Angled region of the rail
8 Latching means of the rail
9 End region of the carrying body
10 Abutment
11 Slope of the abutment
12 Free end of the abutment
13 Hook
14 Step-like tapered portion
15 Sealing lip
16 Free end
17 Opening
20 Distributor plate
21 Through-passage
22 Wall
23 Sealing groove
24 Plug-in spike
25 Longitudinal groove
26 Annular groove
27 Distributor channel
27*a* Central distributor channel
27*b* Outer distributor channel
28 First branching location
29 Second branching location
30 Capillary channel
31 Wedge
32 End of the distributor channel
33 Wall
34 End of the capillary channel
35 Termination edge
36 hollow
37 bottom of the plate
38 cross groove
39 side edge
40 Resilient clip
41 Web
42 Latching channel
43 Free end of the web
44 Nose
45 Region of deflection
46 Segment of the resilient clip
47 Free segment of the resilient clip
48 Angled portion
50 Siphon
51 shaft
52 stand-pipe
53 over-flow edge
54 bulge
55 cap
56 flow of liquid through the siphon
57 branch groove
60 Supply container
61 Stiffening rib
62 End side
63 Rib
64 Latching depression
65 Neck region
66 Opening
67 Sealing cap
68 Liquid active substance
80 Device
90 Opening
91 Semicircular tabs

What is claimed is:

1. A device for dispensing a liquid active substance into flushing water of a toilet bowl, the device comprising:

(a) a supply container for containing the liquid active substance, wherein said supply container has an opening disposed on an underside of said supply container;

(b) a carrying body comprising:

(i) a base having an opening;

(ii) a plurality of sidewalls extending upwardly from said base; and (iii) a plurality of tabs disposed around a portion of a perimeter of said opening of said base and projecting upwardly from said base; and (c) a distributor plate secured to said base of said carrying body, comprising;

(i) a plug-in spike projecting upwardly through said opening in said base of said carrying body and into said opening of said supply container;

(ii) a plurality of grooves circumferentially distributed around said plug-in spike and in fluid communication with the liquid active substance in said supply container;

(iii) a plurality of distributor channels in fluid communication with said plurality of grooves and extending from a base of said plug-in spike in a bowed manner; and (iv) a plurality of capillary channels in fluid communication with said plurality of distributor channels via a plurality of branching locations, wherein each of said plurality of distributor channels supplies a plurality of capillary channels.

2. The device according to claim 1, wherein said distributor plate further comprises a low height wall bounding said plurality of capillary channels.

3. The device according to claim 1, wherein said distributor plate further comprises a cross groove in fluid communication with a terminal end of said plurality of capillary channels, wherein said cross groove is deeper at a center portion and shallower at a side portion.

4. The device according to claim 3, wherein said distributor plate further comprises a shaft-shaped hollow in fluid communication with said cross groove.

5. The device according to claim 4, wherein said distributor plate further comprises a siphon disposed at a bottom of said shaft-shaped hollow.

6. The device according to claim 1, wherein said carrying body further comprises a plurality of outer rails disposed on one of said plurality of sidewalls.

7. The device according to claim 6, further comprising a resilient clip secured to said carrying body with said plurality of outer rails.

8. The device according to claim 1, further comprising a plurality of abutments integral with said carrying body and projecting out from one of said sidewalls.

* * * * *